US011231038B2

(12) United States Patent
Zhang et al.

(10) Patent No.: US 11,231,038 B2
(45) Date of Patent: Jan. 25, 2022

(54) LOAD IDENTIFICATION METHOD FOR RECIPROCATING MACHINERY BASED ON INFORMATION ENTROPY AND ENVELOPE FEATURES OF AXIS TRAJECTORY OF PISTON ROD

(71) Applicant: Beijing University of Chemical Technology, Beijing (CN)

(72) Inventors: Jinjie Zhang, Beijing (CN); Zhinong Jiang, Beijing (CN); Xudong Zhang, Beijing (CN); Zhiwei Mao, Beijing (CN); Yao Wang, Beijing (CN)

(73) Assignee: Beijing University of Chemical Technology, Beijing (CN)

( * ) Notice: Subject to any disclaimer, the term of this patent is extended or adjusted under 35 U.S.C. 154(b) by 0 days.

(21) Appl. No.: 17/088,863

(22) Filed: Nov. 4, 2020

(65) Prior Publication Data

US 2021/0140431 A1 May 13, 2021

(30) Foreign Application Priority Data

Nov. 7, 2019 (CN) ..... 201911079879.2

(51) Int. Cl.
*F04C 28/28* (2006.01)

(52) U.S. Cl.
CPC ..... *F04C 28/28* (2013.01); *F04C 2240/81* (2013.01); *F04C 2270/01* (2013.01); *F04C 2270/86* (2013.01)

(58) Field of Classification Search
CPC .. F04C 28/28; F04C 2240/81; F04C 2270/01; F04C 2270/86; F04B 49/02; F04B 49/00; F04B 51/00
See application file for complete search history.

(56) References Cited

U.S. PATENT DOCUMENTS

| | | | | |
|---|---|---|---|---|
| 2018/0282633 | A1* | 10/2018 | Van de Cotte | C07C 5/333 |
| 2020/0118675 | A1* | 4/2020 | Schriver | G16H 40/40 |
| 2021/0026312 | A1* | 1/2021 | Gervais | G06N 3/084 |
| 2021/0255059 | A1* | 8/2021 | Zhang | G01M 13/00 |

* cited by examiner

*Primary Examiner* — Connor J Tremarche
(74) *Attorney, Agent, or Firm* — DLA Piper LLP (US)

(57) ABSTRACT

A load identification method for reciprocating machinery based on information entropy and envelope features of an axis trajectory of a piston rod. According to the present disclosure, firstly, the position of an axial center is calculated according to a triangle similarity theorem to obtain an axial center distribution; secondly, features are extracted from the axial center distribution of the piston rod by means of an improved envelope method for discrete points as well as an information entropy evaluation method; thirdly, a dimensionality reduction is carried out on the features by means of manifold learning to form a set of sensitive features of the load; and finally, a neural network is trained to obtain a load identification classifier to fulfill automatic identification on the operating load of the reciprocating machinery. The advantages of the present disclosure are verified by means of actual data of a piston rod of a reciprocating compressor.

1 Claim, 6 Drawing Sheets

LOAD IDENTIFICATION METHOD FOR RECIPROCATING MACHINERY BASED ON INFORMATION ENTROPY AND ENVELOPE FEATURES OF AXIS TRAJECTORY OF PISTON ROD

CROSS-REFERENCE TO RELATED APPLICATIONS

This application claims priority to Chinese Application Serial No. 201911079879.2, filed on Nov. 7, 2019, the content of which is incorporated herein by reference in its entirety.

TECHNICAL FIELD

The present disclosure relates to a load identification method for reciprocating machinery.

BACKGROUND

A load variation typically refers to changes of dynamic characteristics of mechanical structures, which lead to an influence on fault features of vibration signals, displacement signals, and the like. It has always been difficult to implement fault monitoring and diagnosis in variable load conditions. Piston rods as movable key parts of reciprocating machinery are prone to causing loosening, cracking, or even breaking to fasteners. There have been many research reports on the fault monitoring and diagnosis of the reciprocating machinery as well as research reports on axis trajectories of the piston rods. For example, an acoustic emission technology is adopted to perform on-line monitoring on the piston rods to pre-warn accidents. A method for fault diagnosis and analysis based on the axis trajectories of the piston rods in the X direction and Y direction can fulfill an early warning of potential faults on the piston rods and piston assemblies of the reciprocating machinery. A harmonic wavelet is used to extract vibration energy, natural frequencies, areas of trajectory envelopes, and other features based on the axis trajectories of the piston rods for fault diagnosis.

At present, there are few reports on the extraction of motion features of the piston rods in the variable load conditions. When a change to the load conditions and faults occur simultaneously, it is necessary to determine why the load conditions of the piston rods change, and the features of influences on loads and the faults should be deeply researched to prevent the faults from being falsely determined. Accordingly, it can be valuable to research transient motion features of the piston rods in the variable load conditions. In view of this, the present disclosure provides a method for extracting information entropy and envelope features of a discrete point distribution contour based on an axis trajectory of a piston rod, which extracts the features of the axis trajectory of the piston rod in different load conditions and establishes a set of sensitive feature parameters of a load as well as a load identification model by means of training.

SUMMARY

The objective of the present disclosure is to provide a simple and effective load identification method for reciprocating machinery, which extracts information entropy and envelope features based on data of an axis trajectory to establish a set of sensitive features of the load for load identification on reciprocating machinery. The present disclosure has simple calculation, high adaptability, high accuracy in identification, and the like.

The objective of the present disclosure is fulfilled through the following technical solution: firstly, the position of an axial center is calculated based on settlement data and deflection data of a piston rod; secondly, an envelope feature of an axial center distribution is extracted by means of an improved envelope method for a discrete point distribution contour, then an information entropy feature of the axial center distribution is calculated, and an initial feature set is formed by the envelope feature and the information entropy feature; and thirdly, sensitive features of the load are extracted from the initial feature set by means of manifold learning to form a set of the sensitive features of the load, and a neural network is trained by means of the set of the sensitive features of the load to obtain an identification classifier.

A load identification method for reciprocating machinery based on information entropy and envelope features of an axis trajectory of a piston rod includes the following steps:

step 1. setting different load conditions Load={0, d, 2d, 3d, . . . , wd}, w=0, 1, 2, . . . , where d represents a load gradient, and the number of the load conditions is (w+1) in total; respectively acquiring, by an on-line monitoring system of reciprocating machinery, an original deflection displacement $X_m=\{x_1, x_2, x_3, \ldots, y_m\}$ and original settlement displacement $Y_m=\{y_1, y_2, y_3, \ldots, y_m\}$ of a piston rod in a corresponding load condition through an eddy current displacement sensor (deflection sensor) in a horizontal direction and an eddy current displacement sensor (settlement sensor) in a vertical direction to obtain an original data set $XY_n=\{(X_m,Y_m)_1^T, (X_m,Y_m)_2^T, \ldots, (X_m,Y_m)_n^T\}^T$, where m represents the number of sampling points, and n represents the number of data groups;

step 2. removing average values of an original signal $X_m$ and an original signal $Y_m$ by means of formula (1) to obtain $X'_m=\{x'_1, x'_2, x'_3, \ldots, x'_m\}$ and $Y'_m=\{y'_1, y'_2, y'_3, \ldots, y'_m\}$, where the original data set is turned to $XY'_n=\{(X'_m,Y'_m)_1^T, (X'_m,X'_m)_2^T, \ldots, (X'_m,Y'_m)_n^T\}^T$ $$F'_m(j) = F_m(i) - \frac{1}{m}\sum_{i=1}^{m} F_m(i) \quad (1)$$

$$i, j = 1, 2, \ldots, m$$

where, in formula (1), $F_m$ represents the original deflection or settlement displacement of the piston rod, and $F'_m$ represents the deflection or settlement displacement, obtained after the average values are removed, of the piston rod; and setting a horizontal direction measured by a deflection sensor as an X-axis and a vertical direction measured by a settlement sensor as a Y-axis to build a plane-rectangular coordinate system, where if a position of an axial center of the piston rod at an initial time is denoted by $O_0(a_0, b_0)$, the position of the axial center of the piston rod at another time is denoted by $O_m(a_m,b_m)$, and a radius of the piston rod is denoted by R, a point of intersection between a circumference of the piston rod and the X-axis at this time is $J_X(R+x'_m,0)$, and a point of intersection between the circumference of the piston rod and the Y-axis at the time is $J_Y(0,R+y'_m)$; setting an included angle between the X-axis and a line connecting the point $O_m$ to the point $J_X$ as θ and an included angle between a line connecting the point $O_m$ to the point $J_Y$ and a straight line, parallel to the X-axis, on which the point $O_m$ is located as φ to derive formula (2) and formula (3) according to a triangle similarity theorem; and solving, by means of formula (2) in combination with formula (3), the position $O_m(a_m,b_m)$ of the axial center of the piston rod at different times to form an axial center distribution set $O=\{O_1(a_1,b_1), O_2(a_2,b_2), O_3(a_3,b_3), \ldots, O_m(a_m, b_m)\}$ $$\begin{cases} \dfrac{R + X'_m(j) + a_m}{X'_m(j)} = \dfrac{R}{X'_m(j)/\cos\theta} \\ \theta = \arctan\dfrac{b_m}{R + X'_m(j) + a_m} \end{cases} \tag{2}$$

$$\begin{cases} \dfrac{R + Y'_m(j) - b_m}{Y'_m(j)} = \dfrac{R}{Y'_m(j)/\sin\varphi} \\ \varphi = \arctan\dfrac{R + Y'_m(j) - b_m}{a_m} \end{cases} \tag{3}$$

where, in formula (2) and formula (3), j=1, 2, 3, . . . , m step 3. calculating an envelope feature $B_{ao}$ of the axial center distribution $O=\{O_1(a_1,b_1), O_2(a_2,b_2), O_3(a_3,b_3), \ldots, O_m(a_m,b_m)\}$ by means of an improved envelope method for a discrete point distribution contour, where the improved envelope method for the discrete point distribution contour particularly includes the following steps:

step 3.1. determining, according to the axial center distribution O, four limit points by seeking a minimum point $a_l$ and a maximum point $a_r$ in the horizontal direction X as well as a minimum point $b_d$ and a maximum point $b_u$ in the vertical direction Y, where the four limit points are respectively denoted by $O_l(a_l,b_l)$, $O_r(a_r,b_r)$, $O_d(a_d,b_d)$, $O_u(a_u,b_u)$, an inside of a quadrangle formed by the four limit points is counted as an internal side, and an outside of the quadrangle is counted as an external side;

step 3.2. extracting a convex envelope of an axial center distribution contour at a minimum slope with the foregoing limit points as starting points by anticlockwise traversing all over the positions of the axial center at all times; and calculating a convex envelope between a limit point $O_d$ and a limit point $O_r$ through a method including the following steps;

(1) setting a line connecting the point $O_d$ to the point $O_r$ as $L_1$, where a slope $\alpha_1$ of the line is expressed as:

$$\alpha_1 = \frac{b_d - b_r}{a_d - a_r} \tag{4}$$

(2) if a set of all common axial center points on an external side of the line $L_1$ is assumed as $P=\{p_1(a_1,b_1), p_2(a_2,b_2), p_3(a_3,b_3), \ldots\}$, calculating a slope $K=\{\beta_1, \beta_2, \beta_3, \ldots\}$ of a line connecting the point $O_d$ to any point in P; if there are multiple points with a same slope, calculating a distance $D=\{dis_1, dis_2, dis_3, \ldots\}$ between the corresponding point and the point $O_d$; and seeking a point $p'(a_p,b_p)$ in the set P, and enabling p' to meet the following formula:

$$\beta' = \min K, \beta' \leq \alpha_1, \text{ and } dis' = \max D \tag{5}$$

where, in formula (5), β' represents a slope of a line connecting the point p' to the point $O_d$, and dis' represents a distance between the point p' and the point $O_d$; and the point p' is a convex envelope point;

(3) replacing the point $O_d$ with the convex envelope point p', setting a line connecting the point p' to the point $O_r$ as $L'_1$ and a slope of the line $L'_1$ as $\alpha'_1$, and then carrying out a next iteration to seek a new convex envelope point;

(4) repeating step (1), step (2), and step (3); and when a distance between the new convex envelope point and the point $O_r$ is 0, stopping the iteration to obtain a convex envelope $B'_{dr}=\{p'_1, p'_2, p'_3, \ldots\}$ of an axial center distribution contour between the limit point $O_d$ and the limit point $O_r$; and calculating a convex envelope $B'_{ru}$ between the limit point $O_r$ and a limit point $O_u$, a convex envelope $B'_{ud}$ between the limit point $O_u$ and a limit point $O_l$, and a convex envelope $B'_{ld}$ between the limit point $O_l$ and the limit point $O_d$ to obtain a set $B_{tu}=\{O_d, B'_{dr}, O_r, B'_{ru}, O_u, B'_{ul}, O_l, B'_{ld}\}$ of all convex envelope points in the axial center distribution;

(5) calculating an area S1 of the convex envelope of the axial center distribution contour by means of formula (6) below:

$$S1 = \frac{1}{2}\sum_{e=1}^{c1}(a_{pe} * b_{p(e+1)} - a_{p(e+1)} * b_{pe}) \tag{6}$$

where, in formula (6), c1 represents the number of the convex envelope points;

step 3.3. calculating a concave envelope of the axial center distribution according to the convex envelope obtained in step 3.2; and calculating a concave envelope between the limit point $O_d$ and the limit point $O_r$ by successively anticlockwise carrying out the following calculation on two continuous convex envelope points $p'_1(a_{p1},b_{p1})$ and $p'_2(a_{p2},b_{p2})$ in the convex envelope $B'_{dr}=\{p'_1, p'_2, p'_3, \ldots\}$:

(1) setting a line connecting the point $p'_1(a_{p1},b_{p1})$ to the point $p'_2(a_{p2},b_{p2})$ as $L_2$, where a slope $\alpha_2$ of the line L' is expressed as:

$$\alpha_2 = \frac{b_{p2} - b_{p1}}{a_{p2} - a_{p1}} \tag{7}$$

(2) if a set of all common axial center points on an internal side of the line $L_2$ is assumed as $Q=\{q_1(a_1,b_1), q_2(a_2,b_2), q_3(a_3,b_3), \ldots\}$, calculating a slope $K'=\{\beta'_1, \beta'_2, \beta'_3, \ldots\}$ of a line connecting the point $p'_1$ to any point in Q; if there are multiple points with a same slope, calculating a distance $D'=\{dis'_1, dis'_2, dis'_3, \ldots\}$ between the corresponding point and the point $p'_1$; and seeking a point $q'(a_q,b_q)$ in the set Q, and enabling q' to meet the following formula:

$$\beta'' = \min K', \beta'' \geq \alpha_2, \text{ and } dis'' = \max D' \tag{8}$$

where, in formula (8), β" represents a slope of a line connecting the point q' to the point $p'_1$, and dis" represents a distance between the point q' and the point $p'_1$; and the point q' is a concave envelope point;

(3) replacing the point $p'_2$ with the concave envelope point q', setting a line connecting the point $p'_1$ to the point q' as $L'_2$ and a slope of the line $L'_2$ as $\alpha_2$, and then carrying out a next iteration to seek a new concave envelope point;

(4) repeating step (1), step (2), and step (3); and when a distance between the new concave envelope point and the point $p'_1$ is not greater than M, stopping the iteration to obtain a concave envelope $B''_{dr}=\{q'_1, q'_2, q'_3, \ldots\}$ of the axial center distribution contour between the limit point $O_d$ and the limit point $O_r$; where, an initial value of M indicates an average distance between two adjacent axial center points, and M is calculated by means of formula (9) in combination with formula (10):

$$M = \frac{2M'}{m(m-1)} \tag{9}$$

$$M' = \sum_{i=2}^{m}\left|\sqrt{(a_1-a_i)^2+(b_1-b_i)^2}\right| + \sum_{i=3}^{m}\left|\sqrt{(a_2-a_i)^2+(b_1-b_i)^2}\right| + \ldots + \sum_{i=m}^{m}\left|\sqrt{(a_{m-1}-a_i)^2+(b_{m-1}-b_i)^2}\right| \tag{10}$$

calculating a concave envelope $B''_{ru}$ between the limit point $O_r$ and a limit point $O_u$, a concave envelope $B''_{ul}$ between the limit point $O_u$ and a limit point $O_l$, and a concave envelope $B''_{ld}$ between the limit point $O_l$ and the limit point $O_d$ to obtain a set $B_{ao}=\{O_d, B''_{dr}, O_r, B''_{ru}, O_u, B''_{ul}, B''_{ld}\}$ of all concave envelope points in the axial center distribution;

(5) calculating an area S2 of the concave envelope of the axial center distribution contour by means of formula (11) below:

$$S2 = \frac{1}{2}\sum_{g=1}^{c2}(a_{qg} * b_{q(g+1)} - a_{q(g+1)} * b_{qg}) \tag{11}$$

where, in formula (11), c2 represents the number of the concave envelope points;

step 3.4. determining whether or not the set $B_{ao}$, obtained in step 3.3, of the concave envelope points is the envelope feature of the axial center distribution of the piston rod;

(1) calculating a relative error E of S2 and S1 by means of formula (12) till E is less than or equal to 5%, where the set $B_{ao}$, obtained in step 3.3, of the concave envelope points is the envelope feature of the axial center distribution of the piston rod after the calculation is stopped;

$$E = \frac{|S2 - S1|}{S1} \times 100\%; \tag{12}$$

and (2) in a case where the distance M is reduced by 50% when E is greater than 5%, replacing S1 with S2, repeating step 3.3 to obtain a new set $B'_{ao}$ of the concave envelope points as well as an area S2' of the concave envelope; and repeatedly calculating a relative error E' of S2' and S2 by means of formula (13) till E' is less than or equal to 5%, where the iteration is stopped at this moment, and the set $B'_{ao}$ obtained in Step 3.3 is the envelope feature of the axial center distribution of the piston rod during the last iteration;

$$E' = \frac{|S2' - S2|}{S2} \times 100\% \tag{13}$$

step 4. calculating an information entropy feature of the axial center distribution O: calculating, by means of formula (14), arithmetic square roots of coordinates of all the points in the axial center distribution O to obtain a set $S_m=\{s_1, s_2, s_3, \ldots, s_m\}$, and then calculating the information entropy feature Sh of the axial center distribution O by means of formula (15), where an initial feature set $T=\{B_{ao}, Sh\}$ is formed by the information entropy feature Sh and the envelope feature;

$$S_m(i') = \left|\sqrt{a_k^2 + b_k^2}\right|, k, i' = 1, 2, \ldots, m \tag{14}$$

$$Sh = -\sum_{i'=1}^{m}\left(\frac{|S_m(i')|}{\sum_{i'=1}^{m}|S_m(i')|} * \log_2\left(\frac{|S_m(i')|}{\sum_{i'=1}^{m}|S_m(i')|}\right)\right) \tag{15}$$

step 5. carrying out, by means of t-distributed stochastic neighbor embedding (T-SNE), an unsupervised dimensionality reduction on the initial feature set to extract sensitive features of a load; and assuming that the initial feature set T includes 1*Col-dimensional features, given perplexity is 30, and a given learning rate is 1e-5, setting a label as Labels={0, 1, 2, . . . , w}, and then inputting the initial feature set T to a T-SNE algorithm for the unsupervised dimensionality reduction in the (w+1) load conditions to obtain a set $T'=\{t_1,t_2\}$ of the sensitive features of a 1*2-dimensional load; and step 6. firstly, sorting data acquired by the on-line monitoring system in the (w+1) load conditions to form a training set and a test set; secondly, processing the data in the training set and the test set through the above steps to obtain a final training set Train_T' and a final test set Test_T'; and thirdly, setting, according to different reciprocating machinery, the number of neurons of a back-propagation (BP) neural network as 20-30, a learning rate as 0.0005-0.001, training accuracy as 0.0001-0.0005, and maximum iterations as 70-100, then inputting the data set Train_T' to the BP neural network for training to obtain a classifier capable of distinguishing the (w+1) load conditions of the reciprocating machinery, and testing the classifier of the BP neural network by means of the test set Test_T'.

DETAILED DESCRIPTION

For the sake of better understanding of the technical solution of the present disclosure, the specific embodiments of the present disclosure are further expounded below with reference to data of a piston rod of a reciprocating compressor and the accompanying drawings.

Figure 1:
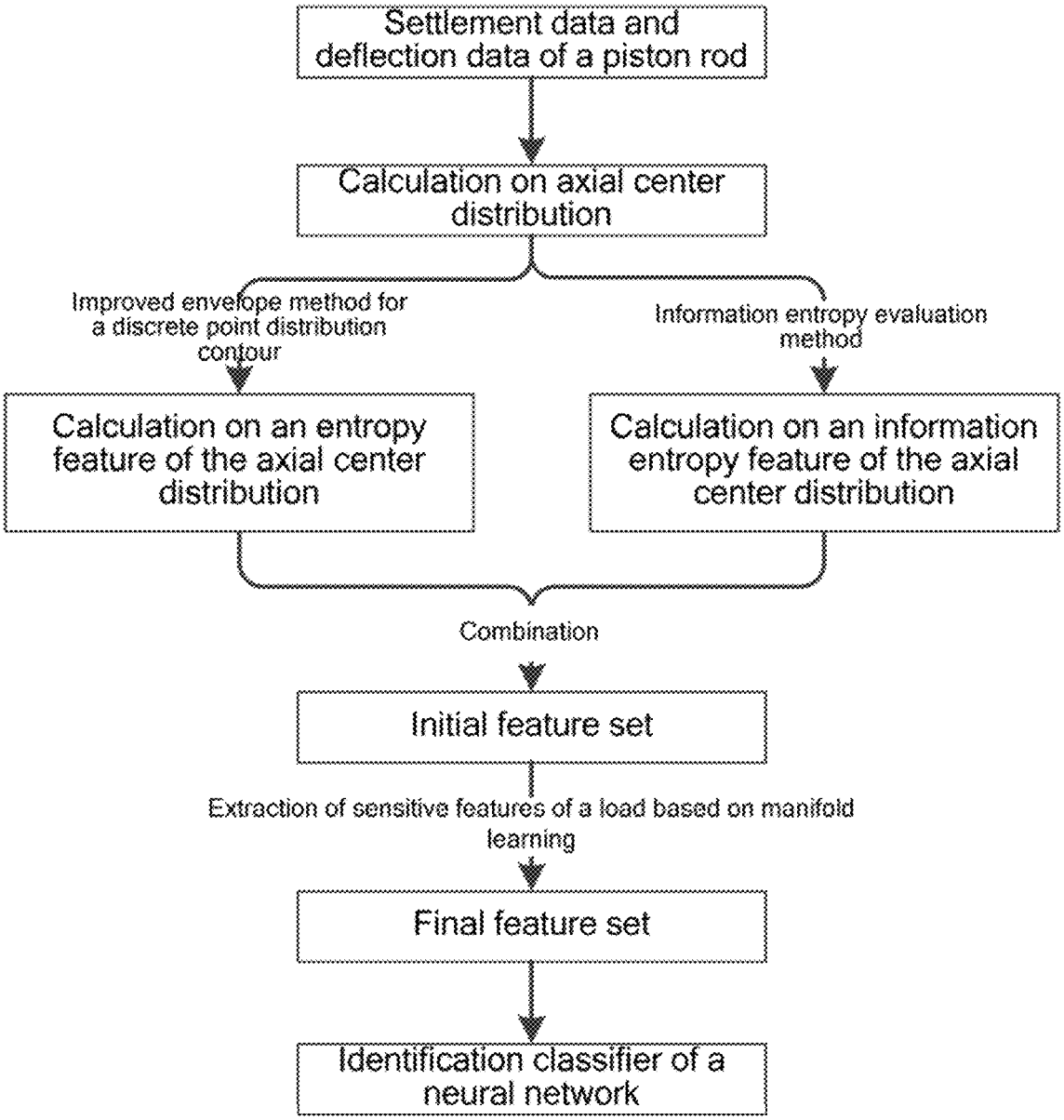
FIG. 1 is a flow chart of a method of the present disclosure.
Figure 2:
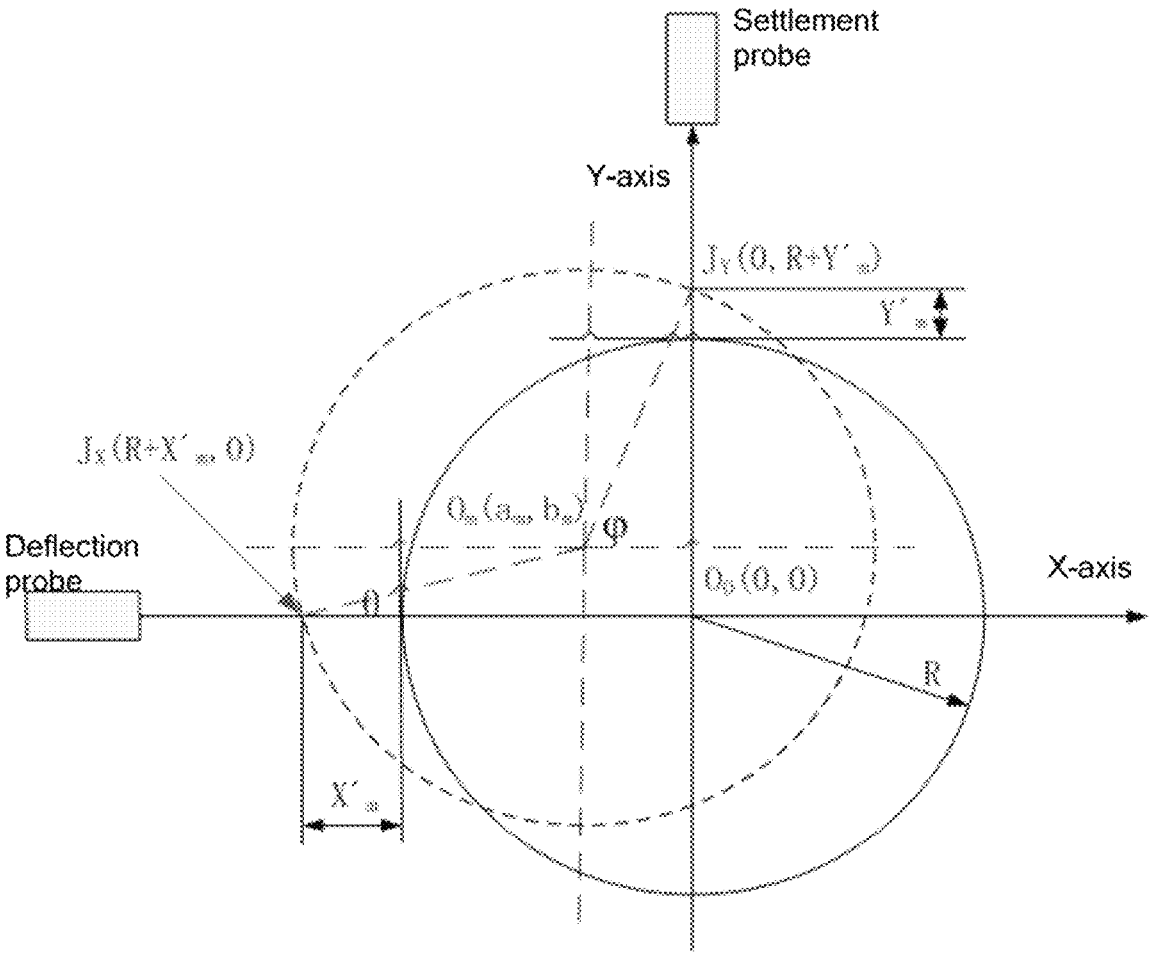
FIG. 2 is a schematic diagram showing the position of an axial center.
Figure 3:
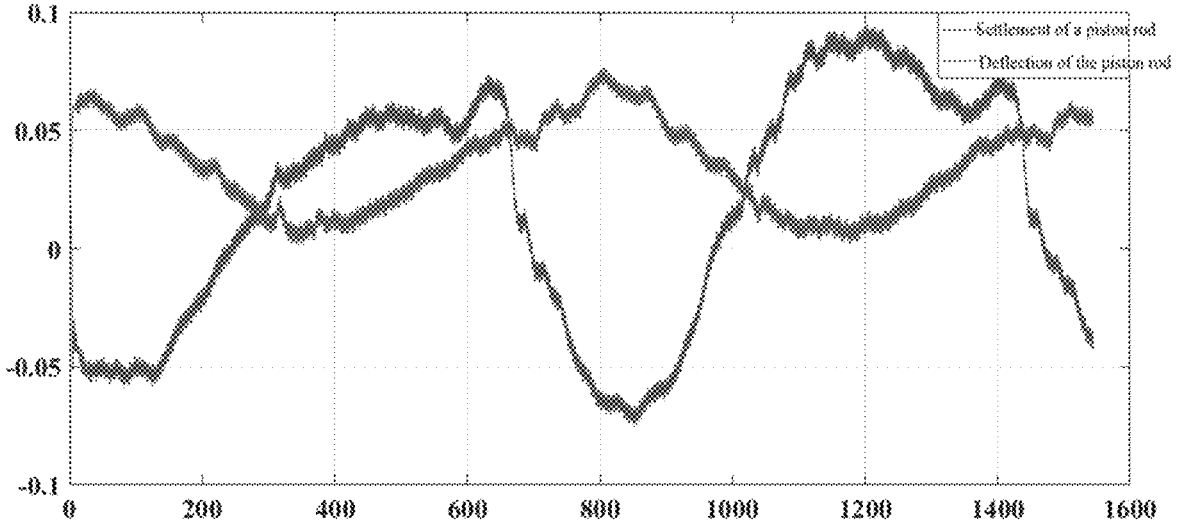
FIG. 3 shows a settlement waveform and deflection waveform of a piston rod of a reciprocating compressor.
Figure 4:
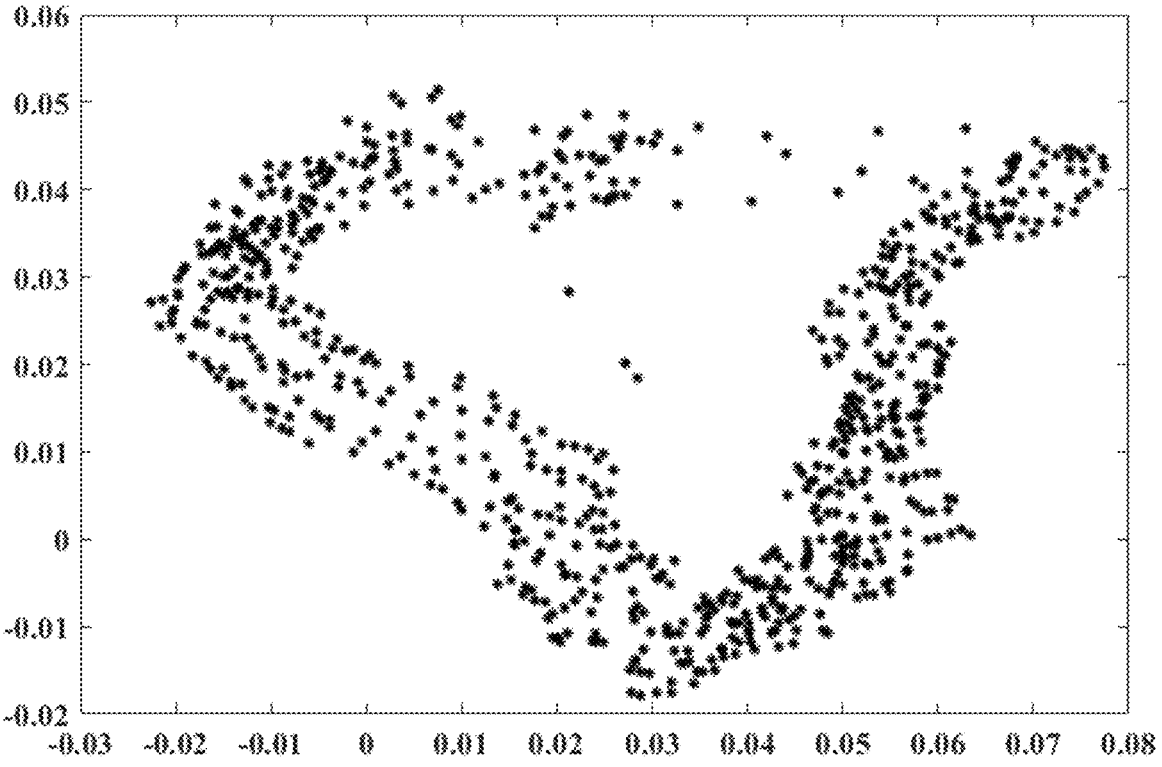
FIG. 4 shows an axial center distribution.
Figure 5:
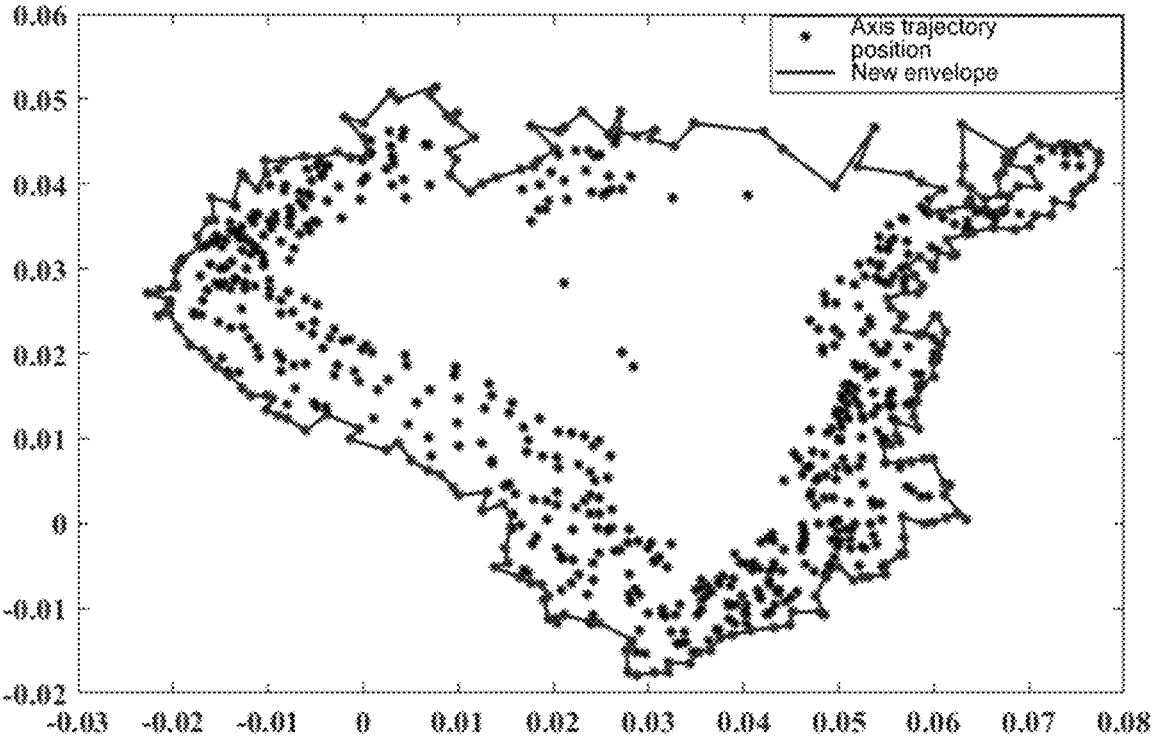
FIG. 5 shows an envelope feature calculated by means of an improved method.
Figure 6:
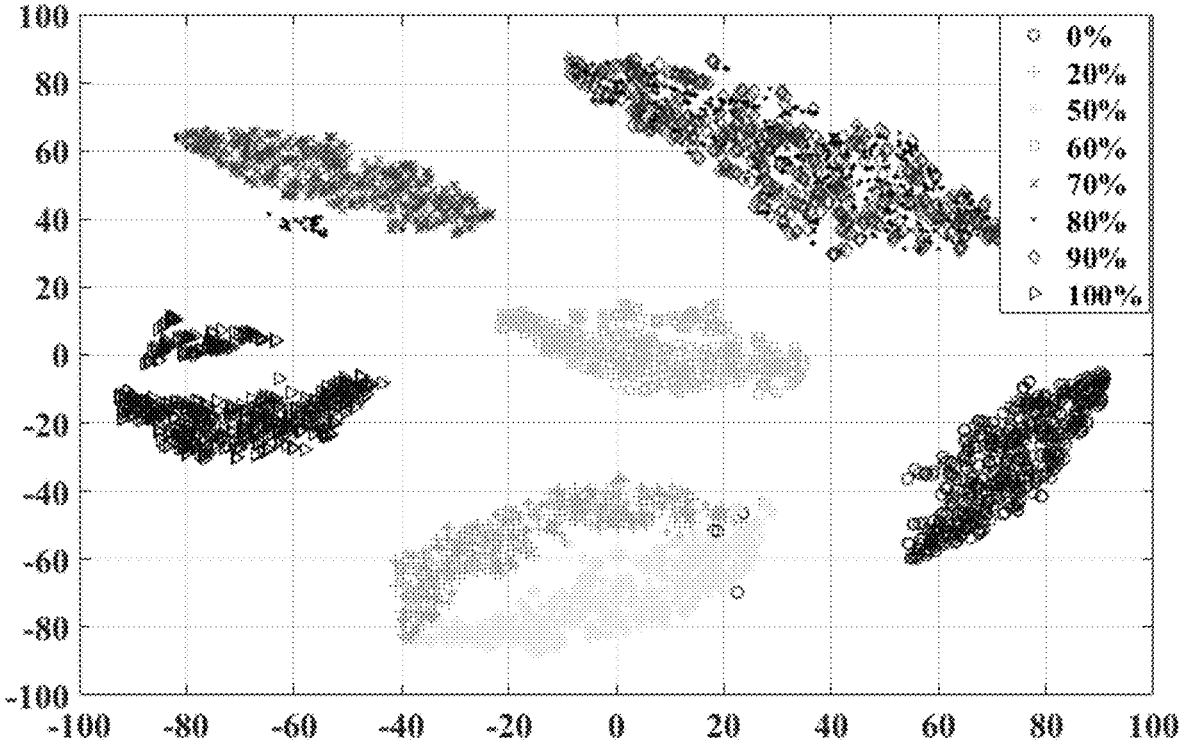
FIG. 6 shows sensitive features of a load.
Figure 7:
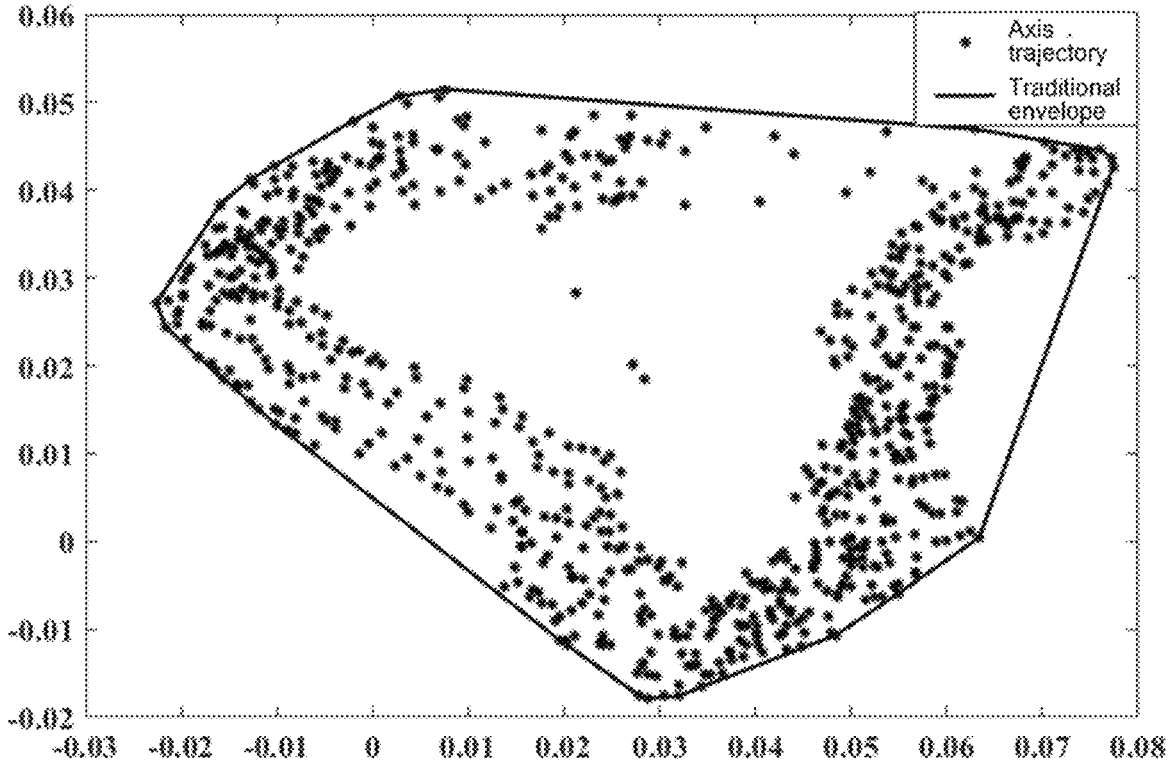
FIG. 7 shows an envelope feature calculated by means of a traditional method.

Step 1. Acquire, by an on-line monitoring system of a reciprocating compressor, deflection data $X_m$ and settlement data $Y_m$ of a piston rod in load conditions of 0%, 20%, 50%, 60%, 70%, 80%, 90%, and 100% to form an original data set $XY_n=\{(X_m,Y_m)_1^T, (X_m,Y_m)_2^T, \ldots, (X_m,Y_m)_n^T\}^T$, where n represents the number of data groups and is equal to 500, waveforms are shown in FIG. 3, original data of eight loads fall into a training set and a test set, and 400 data groups in the training set and 100 data groups in the test set are set for each load;

Step 2. Remove average values of an original signal $X_m$ and an original signal $Y_m$ to obtain $X'_m=\{x'_1, x'_2, x'_3, \ldots, x'_m\}$ and $Y'_m=\{y'_1, y'_2, y'_3, \ldots, y'_m\}$, and solve, according to a triangle similarity theorem, the position of an axial center of the piston rod to obtain an axial center distribution set $O=\{O_1(a_1,b_1), O_2(a_2,b_2), O_3(a_3,b_3), \ldots, O_m(a_m,b_m)\}$, where an axial center distribution is shown in FIG. 4;

Step 3. Calculate an envelope feature $B_{ao}$ of the axial center distribution O by means of an improved envelope method for a discrete point distribution contour, as shown in FIG. 5;

Step 4. Calculate an information entropy feature Sh of the axial center distribution, where an initial feature set $T=\{B_{ao}, Sh\}$ is formed by the information entropy feature and the envelope feature;

Step 5. In a case where given perplexity is 30 and a given learning rate is 1e-5, extract sensitive features of the loads from T by means of manifold learning to form a set $T'=\{t_1,t_2\}$ of the sensitive features of the loads, as shown in FIG. 6; and Step 6. Process the data from the training set and the test set through Step 2 to Step 5 to respectively obtain a final training feature set Train_T' and a final test feature set Test_T'; and set the number of neurons of a back-propagation (BP) neural network as 30, a learning rate as 0.001, training accuracy as 0.0001, and maximum iterations as 100, input the data set Train_T' to the BP neural network for training to obtain a classifier capable of distinguishing 8 load conditions of the reciprocating compressor, test the classifier of the BP neural network by means of the test set Test_T', and compare the improved envelope method with a traditional envelope method for extracting the envelope feature (as shown in FIG. 7); where, a result is shown in Table 1.

TABLE 1 identification accuracy of the neural network (100 sets of test data/load conditions)

| Load/% | 0 | 20 | 50 | 60 | 70 | 80 | 90 | 100 | Overall identification accuracy/% |
|---|---|---|---|---|---|---|---|---|---|
| Traditional envelope method + information entropy | 93 | 100 | 77 | 77 | 98 | 96 | 63 | 51 | 81.88 |
| Improved envelope method + information entropy | 99 | 100 | 97 | 100 | 100 | 100 | 47 | 74 | 89.63 |

What is claimed is:

1. A load identification method for reciprocating machinery based on information entropy and envelope features of an axis trajectory of a piston rod, comprising the following steps:

step 1. setting different load conditions Load={0, d, 2d, 3d, . . . , wd}, w=0, 1, 2, . . . , wherein d represents a load gradient, and the number of the load conditions is (w+1) in total; respectively acquiring, by an on-line monitoring system of reciprocating machinery, an original deflection displacement $X_m=\{x_1, x_2, x_3, \ldots, x_m\}$ and original settlement displacement $Y_m$ $\{Y_1, Y_2, Y_3, \ldots, y_m\}$ of a piston rod in a corresponding load condition through an eddy current displacement sensor in a horizontal direction and an eddy current displacement sensor in a vertical direction to obtain an original data set $XY_n=\{(X_m,Y_m)_1^T (X_m,Y_m)_2^T, \ldots, (X_m,Y_m)_n^T\}^T$, wherein m represents the number of sampling points, and n represents the number of data groups;

step 2. removing average values of an original signal $X_m$ in and an original signal $Y_m$ by means of formula (1) to obtain $X'_m=\{x'_1, x'_2, x'_3, \ldots, x'_m\}$ and $Y'_m=\{y'_1, y'_2, y'_3, \ldots, y'_m\}$, wherein the original data set is turned to $XY'_n=\{(X'_m,Y'_m)_1^T, (X'_m,Y'_m)_2^T, \ldots, (X'_m,Y'_m)_n^T\}^T$ $$F'_m(j) = F_m(i) - \frac{1}{m}\sum_{i=1}^{m} F_m(i) \quad (1)$$

$$i, j = 1, 2, \ldots, m$$

wherein, in formula (1), $F_m$ represents the original deflection or settlement displacement of the piston rod, and $F'_m$ represents the deflection or settlement displacement, obtained after the average values are removed, of the piston rod; and setting a horizontal direction measured by a deflection sensor as an X-axis and a vertical direction measured by a settlement sensor as a Y-axis to build a plane-rectangular coordinate system, wherein if a position of an axial center of the piston rod at an initial time is denoted by $O_0(a_0,b_0)$, the position of the axial center of the piston rod at another time is denoted by $O_m(a_m,b_m)$, and a radius of the piston rod is denoted by R, a point of intersection between a circumference of the piston rod and the X-axis at this time is $J_x$ $(R+x'_m,0)$, and a point of intersection between the circumference of the piston rod and the Y-axis at the time is $J_Y$ $(0,R+y'_m)$; setting an included angle between the X-axis and a line connecting the point $O_m$ to the point $J_x$ as θ and an included angle between a line connecting the point $O_m$ to the point $J_y$ and a straight line, parallel to the X-axis, on which the point $O_m$ is located as φ to derive formula (2) and formula (3) according to a triangle similarity theorem; and solving, by means of formula (2) in combination with formula (3), the position $O_m$ $(a_m, b_m)$ of the axial center of the piston rod at different times to form an axial center distribution set $$O = \{O_1(a_1, b_1), O_2(a_2, b_2), O_3(a_3, b_3), \ldots, O_m(a_m, b_m)\} \quad (2)$$

$$\begin{cases} \dfrac{R + X'_m(j) + a_m}{X'_m(j)} = \dfrac{R}{X'_m(j)/\cos\theta} \\ \theta = \arctan\dfrac{b_m}{R + X'_m(j) + a_m} \end{cases}$$

$$\begin{cases} \dfrac{R + Y'_m(j) - b_m}{Y'_m(j)} = \dfrac{R}{Y'_m(j)/\sin\varphi} \\ \varphi = \arctan\dfrac{R + Y'_m(j) - b_m}{a_m} \end{cases} \quad (3)$$

wherein, in formula (2) and formula (3), j=1, 2, 3, . . . , m step 3. calculating an envelope feature $B_{ao}$ of the axial center distribution $O=\{O_1 (a_1, b_1), O_2 (a_2, b_2), \ldots, O_3 (a_3, b_3), \ldots, O_m (a_m, b_m)\}$ by means of an improved envelope method for a discrete point distribution contour, wherein the improved envelope method for the discrete point distribution contour particularly comprises the following steps:

step 3.1. determining, according to the axial center distribution O, four limit points by seeking a minimum point $a_l$ and a maximum point $a_r$ in the horizontal direction X as well as a minimum point $b_d$ and a maximum point $b_u$ in the vertical direction Y, wherein the four limit points are respectively denoted by $O_l(a_l, b_l)$,$O_r$ $(a_r,b_r)$,$O_d$ $(a_d,b_d)$,$O_u$ $(a_u, b_u)$, an inside of a quadrangle formed by the four limit points is counted as an internal side, and an outside of the quadrangle is counted as an external side;

step 3.2. extracting a convex envelope of an axial center distribution contour at a minimum slope with the foregoing limit points as starting points by anticlockwise traversing all over the positions of the axial center at all times; and calculating a convex envelope between a limit point $O_d$ and a limit point $O_r$ through a method comprising the following steps;

(1) setting a line connecting the point $O_d$ to the point $O_r$ as $L_1$, wherein a slope $\alpha_1$ of the line is expressed as:

$$\alpha_1 = \frac{b_d - b_r}{a_d - a_r} \tag{4}$$

(2) if a set of all common axial center points on an external side of the line $L_1$ is assumed as $P=\{p_1 (a_1,b_1), p_2 (a_2 b_2), p_3 (a_3b_3), \ldots\}$, calculating a slope $K=\{\beta_1, \beta_2,\beta_3, \ldots\}$ of a line connecting the point $O_d$ to any point in P; if there are multiple points with a same slope, calculating a distance $D=\{dis_1,dis_2,dis_3, \ldots\}$ between the corresponding point and the point $O_d$; and seeking a point $p'(a_p,b_p)$ in the set P, and enabling p' to meet the following formula:

$$\beta'=\min K, \beta' \leq \alpha_1, \text{ and } dis'=\max D \tag{5}$$

wherein, in formula (5), β' represents a slope of a line connecting the point p' to the point $O_d$, and dis' represents a distance between the point p' and the point $O_d$; and the point p' is a convex envelope point;

(3) replacing the point $O_d$ with the convex envelope point p', setting a line connecting the point p' to the point $O_r$ as $L'_1$ and a slope of the line $L'_1$ as $\alpha'_1$, and then carrying out a next iteration to seek a new convex envelope point;

(4) repeating step (1), step (2), and step (3); and when a distance between the new convex envelope point and the point $O_r$ as 0, stopping the iteration to obtain a convex envelope $B'_{dr}=\{p'_1,p'_2,p'_3, \ldots\}$ of an axial center distribution contour between the limit point $O_d$ and the limit point $O_r$; and calculating a convex envelope $B'_{ru}$ between the limit point $O_r$ and a limit point $O_u$, a convex envelope $B'_{ul}$ between the limit point $O_u$ and a limit point $O_l$, and a convex envelope $B'_{ld}$ between the limit point $O_l$ and the limit point $O_d$ to obtain a set $B_{tu}=\{O_d, B'_{dr},O_r,B'_{ru}, O_u, B'_{ul},O_l,B'_{ld}\}$ of all convex envelope points in the axial center distribution;

(5) calculating an area S1 of the convex envelope of the axial center distribution contour by means of formula (6) below:

$$S1 = \frac{1}{2}\sum_{e=1}^{c1}(a_{pe} * b_{p(e+1)} - a_{p(e+1)} * b_{pe}) \tag{6}$$

wherein, in formula (6), c1 represents the number of the convex envelope points;

step 3.3. calculating a concave envelope of the axial center distribution according to the convex envelope obtained in step 3.2; and calculating a concave envelope between the limit point $O_d$ and the limit point $O_r$ by successively anticlockwise carrying out the following calculation on two continuous convex envelope points $p'_1(a_{p1},b_{p1})$ and $p'_2(a_{p2},b_{p2})$ in the convex envelopes $B'_{dr}=\{p'_1, p'_2, p'_3, \ldots\}$:

(1) setting a line connecting the point $p'_1(a_{p1},b_{p1})$ to the point $p'_2(a_{p2},b_{p2})$ as $L_2$, wherein a slope $\alpha_2$ of the line L' is expressed as:

$$\alpha_2 = \frac{b_{p2} - b_{p1}}{a_{p2} - a_{p1}} \tag{7}$$

(2) if a set of all common axial center points on an internal side of the line $L_2$ is assumed as $Q=\{q_1(a_1, b_1),q_2 (a_2, b_2),q_3(a_3,b_3), \ldots\}$, calculating a slope $K'=\{\beta'_1,\beta'_2, \beta'_3, \ldots\}$ of a line connecting the point $p'_1$ to any point in Q; if there are multiple points with a same slope, calculating a distance $D'=\{dis'_1,dis'_2,dis'_3, \ldots\}$ between the corresponding point and the point $p'_1$; and seeking a point $q'(a_q,b_q)$ in the set Q, and enabling q' to meet the following formula:

$$\beta''=\min K', \beta'' \geq \alpha_2, \text{ and } dis''=\max D' \tag{8}$$

wherein, in formula (8), β" represents a slope of a line connecting the point q' to the point $p'_1$, and dis" represents a distance between the point q' and the point $p'_1$; and the point q' is a concave envelope point;

(3) replacing the point $p'_2$ with the concave envelope point q', setting a line connecting the point $p'_1$ to the point q' as $L'_2$ and a slope of the line $L'_2$ as $\alpha_2$, and then carrying out a next iteration to seek a new concave envelope point;

(4) repeating step (1), step (2), and step (3); and when a distance between the new concave envelope point and the point $p'_1$ is not greater than M, stopping the iteration to obtain a concave envelope $B''_{dr}=\{q'_1, q'_2, q'_3, \ldots\}$ of the axial center distribution contour between the limit point $O_d$ and the limit point $O_r$; wherein, an initial value of M indicates an average distance between two adjacent axial center points, and M is calculated by means of formula (9) in combination with formula (10):

$$M = \frac{2M'}{m(m-1)} \tag{9}$$

$$M' = \sum_{i=2}^{m}\left|\sqrt{(a_1 - a_i)^2 + (b_1 - b_i)^2}\right| + \sum_{i=3}^{m}\left|\sqrt{(a_2 - a_i)^2 + (b_1 - b_i)^2}\right| + \ldots + \sum_{i=m}^{m}\left|\sqrt{(a_{m-1} - a_i)^2 + (b_{m-1} - b_i)^2}\right| \tag{10}$$

calculating a concave envelope $B''_{ru}$ between the limit point $O_r$ and a limit point $O_u$, a concave envelope $B''_{ul}$ between the limit point $O_u$ and a limit point $O_l$, and a concave envelope $B''_{ld}$ between the limit point $O_l$ and the limit point $O_d$ to obtain a set $B_{ao}=\{O_d,B''_{dr},O_r, B''_{ru}O_u,B''_{ul},O_l,B''_{ld}\}$ of all concave envelope points in the axial center distribution;

(5) calculating an area S2 of the concave envelope of the axial center distribution contour by means of formula (11) below:

$$S2 = \frac{1}{2}\sum_{g=1}^{c2}(a_{qg} * b_{q(g+1)} - a_{q(g+1)} * b_{qg}) \tag{11}$$

wherein, in formula (11), c2 represents the number of the concave envelope points;

step 3.4. determining whether or not the set $B_{ao}$, obtained in step 3.3, of the concave envelope points is the envelope feature of the axial center distribution of the piston rod;

(1) calculating a relative error E of S2 and S1 by means of formula (12) till E is less than or equal to 5%, wherein the set $B_{ao}$, obtained in step 3.3, of the concave envelope points is the envelope feature of the axial center distribution of the piston rod after the calculation is stopped;

$$E = \frac{|S2 - S1|}{S1} \times 100\%; \tag{12}$$

and (2) in a case where the distance M is reduced by 50% when E is greater than 5%, replacing S1 with S2, repeating step 3.3 to obtain a new set $B'_{ao}$ of the concave envelope points as well as an area S2' of the concave envelope; and repeatedly calculating a relative error E' of S2' and S2 by means of formula (13) till E' is less than or equal to 5%, wherein the iteration is stopped at this moment, and the set $B'_{ao}$ obtained in Step 3.3 is the envelope feature of the axial center distribution of the piston rod during the last iteration;

$$E' = \frac{|S2' - S2|}{S2} \times 100\% \tag{13}$$

step 4. calculating an information entropy feature of the axial center distribution O: calculating, by means of formula (14), arithmetic square roots of coordinates of all the points in the axial center distribution O to obtain a set $S_m=\{s_1\ s_2, s_3, s_m\}$ of the arithmetic square roots, and then calculating the information entropy feature Sh of the axial center distribution O by means of formula (15), wherein an initial feature set $T=\{B_{ao},Sh\}$ is formed by the information entropy feature Sh and the envelope feature;

$$S_m(i') = \left|\sqrt{a_k^2 + b_k^2}\right|, k, i' = 1, 2, \ldots, m \tag{14}$$

$$Sh = -\sum_{i'=1}^{m}\left(\frac{|S_m(i')|}{\sum_{i'=1}^{m}|S_m(i')|} * \log_2\left(\frac{|S_m(i')|}{\sum_{i'=1}^{m}|S_m(i')|}\right)\right) \tag{15}$$

step 5. carrying out, by means of t-distributed stochastic neighbor embedding (T-SNE), an unsupervised dimensionality reduction on the initial feature set to extract sensitive features of a load; and assuming that the initial feature set T includes 1*Col-dimensional features, given perplexity is 30, and a given learning rate is 1e-5, setting a label as Labels={0,1,2, . . . ,w},and then inputting the initial feature set T to a T-SNE algorithm for the unsupervised dimensionality reduction in the (w+1) load conditions to obtain a set $T'=\{t_1, t_2\}$ of the sensitive features of a 1*2-dimensional load; and step 6. firstly, sorting data acquired by the on-line monitoring system in the (w+1) load conditions to form a training set and a test set; secondly, processing the data in the training set and the test set through the above steps to obtain a final training set Train_T' and a final test set Test_T'; and thirdly, setting, according to different reciprocating machinery, the number of neurons of a back-propagation (BP) neural network as 20-30, a learning rate as 0.0005-0.001, training accuracy as 0.0001-0.0005, and maximum iterations as 70-100, then inputting the data set Train_T' to the BP neural network for training to obtain a classifier capable of distinguishing the (w+1) load conditions of the reciprocating machinery, and testing the classifier of the BP neural network by means of the test set Test_T'.

* * * * *